United States Patent [19]

McInerney

[11] 4,135,627

[45] Jan. 23, 1979

[54] OPERATOR BALANCED, MANUALLY POWERED CRANE

[76] Inventor: James McInerney, 735 Cedarville Rd., Easton, Pa. 18042

[21] Appl. No.: 738,894

[22] Filed: Nov. 4, 1976

[51] Int. Cl.[2] ..... B66C 23/00

[52] U.S. Cl. ..... 212/8 R; 254/139.1

[58] Field of Search ..... 212/8 R, 8 A, 8 B, 9, 212/35 R, 35 HC, 46 R, 46 A, 46 B, 52-55, 58 R, 58 A, 59 R, 59 A; 254/139.1

[56] References Cited

U.S. PATENT DOCUMENTS

| | | | |
|---|---|---|---|
| 845,143 | 2/1907 | Taylor | 212/58 R |
| 935,391 | 9/1909 | Mohan | 212/59 R |
| 1,135,799 | 4/1915 | Hogan | 212/59 R |
| 1,284,277 | 11/1918 | Kattler | 212/8 R |
| 1,398,204 | 11/1921 | Schowalter | 212/59 R |
| 1,824,339 | 9/1931 | Forados et al. | 254/139.1 |
| 3,450,386 | 6/1969 | Ewig et al. | 254/139.1 |
| 3,978,989 | 9/1976 | Avila | 212/55 |

FOREIGN PATENT DOCUMENTS

| | | | |
|---|---|---|---|
| 69112 | 12/1914 | Austria | 212/58 R |
| 465234 | 4/1914 | France | 212/58 R |

*Primary Examiner*—Albert J. Makay
*Assistant Examiner*—R. B. Johnson
*Attorney, Agent, or Firm*—Miller & Prestia

[57] ABSTRACT

A hoisting apparatus has a vertical supporting frame, a rearwardly extending base pivotally connected at the lower end of the frame and capable of closing on the frame, a foldable brace is attached at one end to the frame and at the other end to the base so as to lock the base into a supporting position and unlock the base to be pivoted to a closed position against the frame. A forwardly extending boom is pivotally mounted at the upper end portion of the frame. A first pulley is mounted on the upper end of the frame, and a first winding mechanism is attached to the rearward portion of the frame. A first cable passes from the first winding mechanism over the first pulley to the boom for raising and lowering the boom. A second pulley is mounted at the end of the boom. A second winding mechanism attached to the rearward portion of the frame, and a second cable passes from the second winding mechanism over the second pulley for attachment to a load.

1 Claim, 4 Drawing Figures

OPERATOR BALANCED, MANUALLY POWERED CRANE

BACKGROUND OF THE INVENTION

1. Field of the Invention

The present invention relates to improvement in portable lifting and hoisting devices. More particularly, the present invention relates to a portable hoist which is especially useful for moving and installing heavy objects in a small area.

Many domestic appliances, such as water heaters, air-conditioners, and the like, are installed on shelves or brackets above the floor level, and in the case of some air-conditioners, in windows or other wall openings which are well above the floor level. Often they are too heavy for one man to lift them into place and other than that requirement, one man can perform all of the installation work.

Some warehouses and storage rooms are so equipped as to prevent the utilization of any large power equipment for lifting heavy objects to a stacked position. Also, in areas away from a power source, such as in yards or during delivery by trucks, an occasional heavy and bulky item is required to be lifted and/or moved. With these considerations in mind, the present invention can be utilized however, utilization in other operations or uses can be noted.

2. Description of the Prior Art

Portable lifting or hoisting devices of the derrick or crane type, and consisting of a certain peculiar frame having folding base extensions a pivotally-attached spar or boom, and pushing members or handles, and equipped with hoisting mechanisms are well known. One such device can be found in U.S. Pat. No. 1,284,277 of Ewig et al. The device of this patent contains a worm gear operated winding mechanism which affords all the power necessary for lifting small appliances. There is further provided a large base frame over which the boom moves so as to provide the necessary stability.

U.S. Pat. No. 3,181,707 of Janssen relates to a hoisting apparatus for use in installing and removing heavy domestic appliances which is provided with a swinging crane arm for moving the load.

U.S. Pat. No. 45,865 of Rogers relates to a hoist which is intended to be attached to a hay wagon and used for lifting a load onto the wagon.

SUMMARY OF THE INVENTION

The present invention relates to improvements in portable lifting or hoisting devices which may be readily folded into a compact form when not in use, and as readily unfolded and made ready for use.

The primary object of the present invention is to provide a comparatively light and inexpensive, but strong and durable, conveniently operated and portable device for which a heavy load can be raised, conveyed from one place to another, and lowered with ease, and which can be readily folded into a compact form for storage when not in use.

Another object of the present invention is to provide a hoist which is strong enough to handle a load wherein no power source is available for use in connection with an automatic operation.

A still further object of the present invention is to provide a device which can be manufactured at low cost. The lifting device of the present invention is designed for use in shops, factories, in homes and by delivery vehicles for handling various objects in any place where a portable apparatus is needed for handling a compartively heavy load with a comparatively small expenditure of human energy.

The objects of the present invention may be realized by providing a hoisting apparatus comprising a vertical supporting frame, a rearwardly extending base pivotally connected at the lower end of said frame, foldable brace means attached at one end to said frame and at the other end to said base so as to lock said base into a supporting position and unlock said base to be pivoted to said closed position against said frame, a forwardly extending boom pivotally mounted at the upper end portion of said frame, a first winding mechanism attached to the rearward portion of said frame, a first cable passing from said first winding mechanism over said pulley to said boom for raising and lowering said boom, a second pulley means mounted at the end of said boom, a second winding mechanism attached to the rearward portion of said frame, and a second cable passing from said second mechanism over said second pulley for attachment to a load, whereby operation of said second winding mechanism raises and lowers the load.

These and other objects and advantages of the invention will be more readily apparent from the following detailed description when taken in conjunction with the accompanying drawings wherein:

DESCRIPTION OF THE PREFERRED EMBODIMENTS

Figure 4:
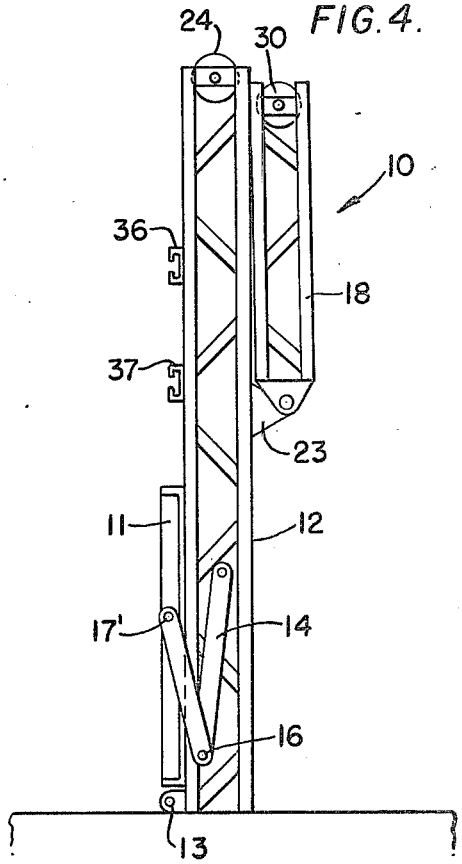
FIG. 4 is a side elevation of the hoist of FIG. 1 in compacted form for storage.

Referring to the drawings, the base structure of the illustrated embodiment of the hoist 10 comprises a base 11 on which an operator O stands. The base 11 is pivotally attached to a vertical supporting frame 12 at 13 with a post 19. A pair of folding braces or arms 14, 14' which lock the base in an operative or supporting position are pivotally connected at one end to a cross-bar 21 which is fixed on said frame 12 and is further pivotally connected at point 17 to the base. The folding braces or arms 14, 14' comprise a pair of segments which are pivotally connected at points 16, 16' so as to permit collapse of the base 11 onto the vertical supporting frame 12 as seen in FIG. 4 when not in use.

Figure 1:
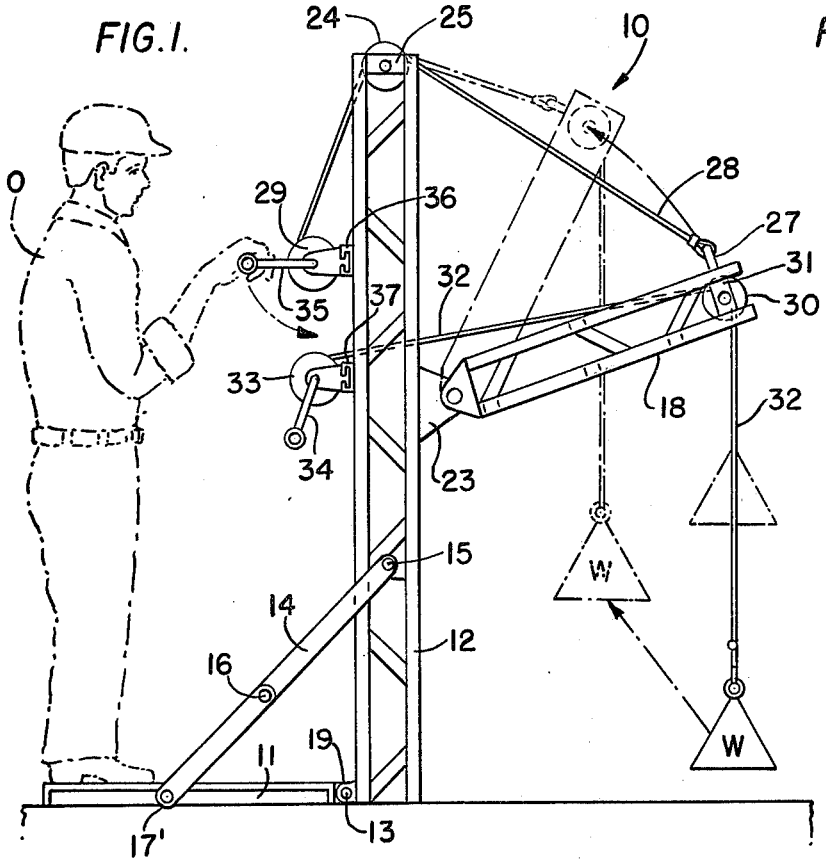
FIG. 1 is a side elevation of a portable hoist that embodies a practical form of the present invention.
Figure 2:
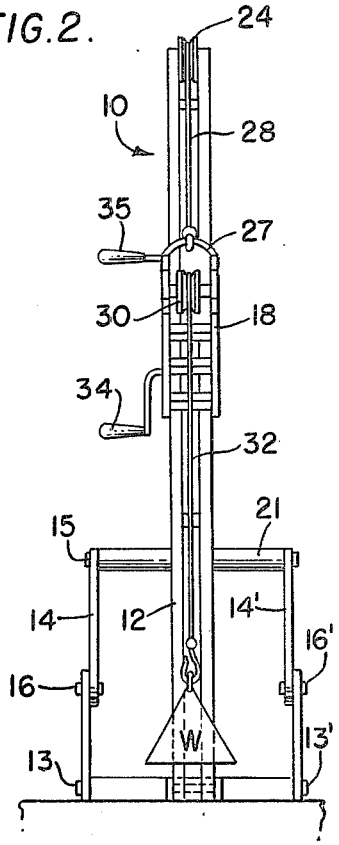
FIG. 2 is a front elevation of the hoist of FIG. 1.

A forwardly-extending upwardly folding boom 18 has its rear end pivotally connected at 22 with the vertical supporting frame 12 at an intermediate part of the frame. The boom 18, need not be a part of the frame of the hoist in the strict sense of the term, but supplementary thereto. The boom 18 is not pivoted directly on the frame 12, in this case, but between and to the forwardly-projecting arms of a pair of brackets 23, which brackets are bolted or otherwise secured to the sides of the frame 12. However, the boom may be so adapted to be pivotally mounted directly on the frame. A pulley 24 is mounted at the upper end of the frame 12 in brackets 25 on an axle member 26 that is mounted in said brackets. An upwardly directed eye-bolt 27 is attached to the boom 18, and a cable 28 has one end fastened to said eye bolt 27. The cable 28 passes rearwardly, from the eye bolt 27, over the pulley 24 and down behind the frame 12 to a winding drum 29 which is attached on the frame 12. It is by means of the cable 28 that the boom is raised and lowered since the boom 18 is swung up and down as it is pivoted on brackets 23, accordingly as said cable is wound on the drum 29 or unwound therefrom. When the cable 28 is paid out sufficiently, the boom 18 is permitted to swing down and into approximately perpendicular relationship with the frame 12 as shown in FIG. 1 as the cable 26 is wound on the winding drum 29, the boom is raised into the position seen by the broken lines in FIG. 1.

At the upper end of the boom 18, a pulley 30 is mounted in a pair of brackets 31. A cable 32 having one end with a suitable means for attachment to a weight W passes rearwardly from the weight W over the pulley 30 to a winding drum 33 which is attached to the frame 12. It is by means of the cable 32 that the weight or load is raised and lowered with respect to the boom. Means may be provided to restrict the downward swing of the boom.

In use, the operator O stands on the base 11 so that the weight of the operator counter-balances the weight of the load W. Then the operator by means of crank 35 rotates the drum 29 to raise and lower the boom 18 and by rotating crank 34 rotates the winding drum 33 so as to wind and unwind the cable 32 and raise or lower the weight W.

Figure 3:
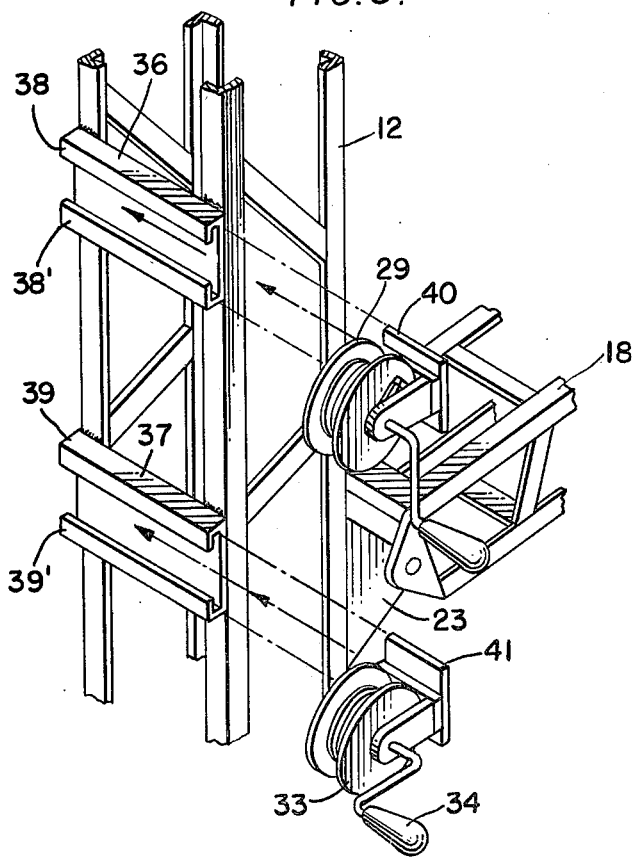
FIG. 3 is a perspective view of the attachment for the hand-operated winding mechanism according to the present invention.

As seen in FIG. 3, in accordance with a further embodiment of the present invention, the winding drums 29 and 33 may be removably mounted on the frame. There is provided a pair of brackets 36 and 37 which are fixed on the frame 12, each having rearwardly-extending bearing arms 38, 38' and 39, 39', between which arms the bases 40 and 41 are slidably inserted. By means of the slidable feature, the winding drums 29 and 33 can be placed on the frame so as to have either a right hand wind or a left hand wind. The winding drums 29 and 33 may comprise either a simple drum or crank or a mechanism wherein the crank actuates the drum through a reduction gear means comprising a driven gear fixed to the drum and a pinion fixed to a shaft to which the crank also is fixed and a manually operable pawl engageable and disengageable with the teeth of a pinion means. This latter type of winch mechanism constitutes an item which is similar to the type disclosed in U.S. Pat. No. 1,284,277.

As seen in FIG. 4, the boom 18 and the base 11 may be folded away against the frame 12 when the frame is not needed and it is desired to store it away in a small space.

The hoist of the present invention may be constructed of lightweight material so as to be readily transported to a point of use. It provides a means whereby heavy loads ordinarily requiring more than one man to lift into or out of position can be conveniently handled by one man utilizing his weight as a counter-balance to efficiently lift and move heavy materials.

The recitation of certain particular uses of the invention is not to be deemed to be by way of limitation, since the hoist is, of course, useful for any purpose for which it is found to be suitable. Accordingly, the invention will not be deemed to be limited to the precise details of structure and the use above set forth by way of example and to include as well, all such changes and modifications in the parts, and in the construction, combination and arrangement of parts as can be made, without departing from the spirit of the invention.

What is claimed is:

1. A hoisting apparatus comprising:

a vertical supporting frame, a rearwardly extending base adapted for having an operator standing thereon providing a counter-balance to the weight to be lifted, said base being pivotably connected at the lower end of said frame and capable of closing on said frame, foldable brace means attached at one end to said frame and at the other end to said base so as to lock said base into a supporting position and unlock said base to be pivoted to said closed position against said frame, a pair of forwardly projecting brackets mounted on said frame, a forwardly extending boom pivotably attached to said pair of forwardly projecting brackets, said boom being upwardly folding, first pulley means mounted on the upper end of said frame, a second pulley means mounted at the end of said boom, a pair of brackets having a mounting base receiving means, said brackets being fixed to the rearward portion of said frame, first and second winding mechanisms each having a mounting base constructed for slidably engaging said mounting base receiving means of said brackets, a first cable passing from said first winding mechanism over said first pulley means to said boom for raising and lowering said boom, and a second cable passing from said second mechanism over said second pulley for attachment to a load, whereby operation of said second winding mechanism raises and lowers the load.

* * * * *